US010215197B2

(12) United States Patent
Kim et al.

(10) Patent No.: US 10,215,197 B2
(45) Date of Patent: Feb. 26, 2019

(54) METHOD, DEVICE, AND SYSTEM FOR CONTROLLING HYDRAULIC PUMP OF CONSTRUCTION MACHINE

(71) Applicant: Doosan Infracore Co., Ltd., Incheon (KR)

(72) Inventors: Dong Mok Kim, Yongin-si (KR); Nag In Kim, Seoul (KR); Yong Tak Hyun, Seoul (KR); Duk Sang Kim, Yongin-si (KR); Byung Il Kang, Seoul (KR); Min Seok Ko, Yongin-si (KR); Jung Ho Kim, Incheon (KR); Kyung Min Park, Yongin-si (KR); Lee Hyoung Cho, Suwon-si (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 560 days.

(21) Appl. No.: 14/783,958

(22) PCT Filed: Apr. 14, 2014

(86) PCT No.: PCT/KR2014/003210

§ 371 (c)(1),
(2) Date: Oct. 12, 2015

(87) PCT Pub. No.: WO2014/168462

PCT Pub. Date: Oct. 16, 2014

(65) Prior Publication Data

US 2016/0047399 A1 Feb. 18, 2016

(30) Foreign Application Priority Data

Apr. 12, 2013 (KR) ..... 10-2013-0040406

(51) Int. Cl.

| | |
|---|---|
| ***E02F 9/00*** | (2006.01) |
| ***F15B 11/028*** | (2006.01) |
| ***F02D 29/04*** | (2006.01) |
| ***E02F 9/22*** | (2006.01) |
| ***F04B 17/05*** | (2006.01) |
| ***F04B 49/06*** | (2006.01) |
| ***F15B 11/08*** | (2006.01) |

(Continued)

(52) U.S. Cl.
CPC ..... *F15B 11/028* (2013.01); *E02F 9/2235* (2013.01); *E02F 9/2296* (2013.01);
(Continued)

(58) Field of Classification Search
CPC ..... F15B 11/028; F15B 11/08; F15B 13/16; F15B 15/28; F15B 2211/765;
(Continued)

(56) References Cited

U.S. PATENT DOCUMENTS 5,944,492 A * 8/1999 Konishi ..... E02F 9/2235 417/222.1
6,010,309 A 1/2000 Takamura et al.
(Continued)

FOREIGN PATENT DOCUMENTS

CN 1692227 11/2005
EP 1571339 9/2005
(Continued)

OTHER PUBLICATIONS

Calculating Pump Torque, EngineersHandbook.*
(Continued)

*Primary Examiner* — F. Daniel Lopez
*Assistant Examiner* — Dustin T Nguyen
(74) *Attorney, Agent, or Firm* — K&L Gates LLP

(57) ABSTRACT

The present disclosure relates to a method, a device, and a system for controlling a hydraulic pump of a construction machine, the system comprising: an engine; an engine control unit configured to control the engine by using engine limit torque information and current engine torque information of the engine; a hydraulic pump operated by power supplied from the engine; at least one actuator driven by a hydraulic pressure discharged from the hydraulic pump; and a hydraulic pump control device configured to control a limited swash plate angle of the hydraulic pump by using a
(Continued)

torque of the hydraulic pump and the engine limit torque information received from the engine control unit.

16 Claims, 6 Drawing Sheets

(51) Int. Cl.
*F15B 13/16* (2006.01)
*F15B 15/28* (2006.01)

(52) U.S. Cl.
CPC ..... *F02D 29/04* (2013.01); *F04B 17/05* (2013.01); *F04B 49/065* (2013.01); *F15B 11/08* (2013.01); *F15B 13/16* (2013.01); *F15B 15/28* (2013.01); *F04B 2201/1202* (2013.01); *F15B 2211/20553* (2013.01); *F15B 2211/255* (2013.01); *F15B 2211/405* (2013.01); *F15B 2211/765* (2013.01)

(58) Field of Classification Search
CPC ..... F15B 2211/20553; F15B 2211/255; F15B 2211/405; F04B 49/065; F04B 17/05; F04B 2201/1202; E02F 9/2235; E02F 9/2296; F02D 29/04
See application file for complete search history.

(56) References Cited

U.S. PATENT DOCUMENTS 6,183,210 B1 * 2/2001 Nakamura ..... E02F 9/2235 417/222.1
7,225,615 B2 * 6/2007 Bankestad ..... E02F 9/2228 60/431
7,370,475 B2 * 5/2008 Nakamura ..... B60W 10/30 60/449
7,533,527 B2 * 5/2009 Naruse ..... E02F 9/2235 60/433
7,797,092 B2 * 9/2010 Schifferer ..... E02F 9/2235 701/50
2002/0073699 A1 * 6/2002 Nishimura ..... B66C 13/18 60/325
2005/0160727 A1 * 7/2005 Nakamura ..... E02F 9/2235 60/431
2010/0186402 A1 * 7/2010 Ariga ..... E02F 9/2225 60/329

FOREIGN PATENT DOCUMENTS

| | | |
|---|---|---|
| JP | 2008169593 | 7/2008 |
| KR | 20050004221 | 1/2005 |
| KR | 20070046853 | 5/2007 |
| KR | 20070096783 | 10/2007 |
| KR | 20100100964 | 9/2010 |

OTHER PUBLICATIONS

Chinese Office Action issued for corresponding Chinese Patent Application 201480020766.4 dated Jul. 25, 2016. 1 page.
International Search Report for International Patent Application PCT/KR2014/003210 dated Jul. 18, 2014. 4 pages.
Extended European Search Report issued in corresponding European Patent Application 14783216.6 dated Nov. 9, 2016. 10 pages.

* cited by examiner

METHOD, DEVICE, AND SYSTEM FOR CONTROLLING HYDRAULIC PUMP OF CONSTRUCTION MACHINE

CROSS REFERENCE TO RELATED APPLICATIONS

The present application is a National Stage of International Application No. PCT/KR2014/003210, filed on Apr. 14, 2014, which claims priority to Korean Patent Application No. 10-2013-0040406, filed on Apr. 12, 2013, the entire contents of each of which are being incorporated herein by reference.

TECHNICAL FIELD

The present disclosure relates to a method, a device, and a system for controlling a hydraulic pump of a construction machine.

BACKGROUND ART

A construction machine, such as a hydraulic shovel, generally includes an engine as a motor, rotates at least one variable capacity type hydraulic pump by using the engine, and drives a hydraulic actuator by pressurized oil discharged from the hydraulic pump to perform a required operation.

When a sudden load generated by the hydraulic pump is transmitted to the engine in the construction machine, the engine may transmit currently generable torque information to a hydraulic pump control unit, and the hydraulic pump control unit may control a response to a torque limit to the sudden load in real time. Since the limit of a torque increase of the hydraulic pump is generally determined according to a predetermined test regulation, when a load is generated under another environment condition is generated during an actual operation of the construction machine, the appropriate torque limit responding control cannot be performed.

To this end, a technology for performing a minimum torque control of the hydraulic pump based on a target engine speed, and limiting a torque increase of the hydraulic pump based on a predetermined torque increase rate from a moment, at which the operating device is operated, to a predetermined time $\Delta T2$ when a time of a non-operation state of an operation device of the construction machine elapses a predetermined time $\Delta T1$ has been suggested.

The related art is a technology for limiting a torque of the hydraulic pump in order to prevent an engine speed from being decreased due to a sudden load generated at a moment when the operating device of the construction machine is operated in the non-operation state. That is, when a duration time of the non-operation state is larger than the predetermined time $\Delta T1$, the hydraulic pump control unit controls a torque control valve of the hydraulic pump so that the hydraulic pump may maintain a minimum pump torque. In this case, when the operating device is suddenly operated, and a maintenance time of the urgent operation is smaller than a predetermined maintenance time $\Delta T2$, the hydraulic pump control unit maintains the minimum pump torque. After the maintenance time of the urgent operation elapses the predetermined maintenance time $\Delta T2$, the hydraulic pump control unit controls a torque of the hydraulic pump not to be increased to a maximum pump torque according to a target engine speed at a time similar to a general engine speed control, and controls the torque of the hydraulic pump to be increased at a decreased speed according to a predetermined torque increase rate K.

As described above, in the related art, information about a current state of the engine is not received from an engine control unit, but a quantitative numerical value for a reaction of the engine is derived by a method, such as a standard load test, and a pump torque control for limiting a pump torque increase rate of the hydraulic pump is performed based on the derived quantitative numerical value. When load follow-up performance of the engine is changed due to various environmental changes (temperature, humidity, atmospheric pressure, and the like) generable during an actual operation of the construction machine, a torque limit of the hydraulic pump is excessive or too little, so that a problem may occur in that the load is not appropriately matched between the engine and the hydraulic pump. In order to prevent the inappropriate load matching, various test environments need to be included in a process of the standard load test, and the like. The various test environments require many calculation loads from the hydraulic pump control unit, and as a result, a product development period is increased and product cost is increased.

Further, an engine performance characteristic indirectly recognized through a pump load torque by the method, such as the standard load test, in the related art is inappropriate to match a load between the engine and the pump. An engine speed behavior characteristic measured by the method for the standard load test and the like may be different from engine performance calculated during the actual control of the engine control unit. That is, since only limited information among engine information required for controlling the pump is used in the related art, the pump control unit cannot accurately recognize a state of the engine, and thus, an engine-pump matching control may not be smoothly performed.

DISCLOSURE

Technical Problem

The present disclosure is conceived so as to solve the problems in the related art, and an object of the present disclosure is to provide a method, a device, and a system for controlling a hydraulic pump of construction machine, which are capable of preventing an increase delay of a pump torque generated according to a control of a pump torque based on a predetermined torque increase rate by an existing hydraulic pump control unit.

Another object of the present disclosure is to provide a method, a device, and a system for controlling a hydraulic pump of a construction machine, which are capable of appropriately matching a load between an engine and a hydraulic pump.

Technical Solution

In order to achieve the objects, a first exemplary embodiment of the present specification provides a system for controlling a hydraulic pump of a construction machine, the system comprising: an engine; an engine control unit configured to control the engine by using engine limit torque information and current engine torque information of the engine; a hydraulic pump operated by power supplied from the engine; at least one actuator driven by a hydraulic pressure discharged from the hydraulic pump; and a hydraulic pump control device configured to control a swash plate angle of the hydraulic pump by using a torque of the hydraulic pump and the engine limit torque information received from the engine control unit.

In order to achieve the objects, a second exemplary embodiment of the present specification provides a method for controlling a hydraulic pump of a construction machine, the method comprising: receiving engine limit torque information and current engine torque information; calculating a torque of the hydraulic pump; and calculating a hydraulic pump output limit, which is to be commanded to the hydraulic pump, by using the received engine limit torque information and the torque of the hydraulic pump.

In order to achieve the objects, a third exemplary embodiment of the present specification provides a device for controlling a hydraulic pump of a construction machine, the device comprising: an engine torque information receiving unit configured to receive engine limit torque information and current engine torque information; a hydraulic pump output limit calculating unit configured to calculate a hydraulic pump output limit, which is to be commanded to the hydraulic pump, by using the engine limit torque information received through the engine torque information receiving unit; and a hydraulic pump flow rate control determining unit configured to determine whether a current hydraulic pump output calculated by using a pump discharge pressure and a pump model is greater than a hydraulic pump output limit calculated by the hydraulic pump output limit calculating unit, determine whether a difference value between the current engine torque information and the engine limit torque information is equal to or smaller than a predetermined reference value, and determine whether a flow rate limit control function is activated; and a hydraulic pump flow rate limit control unit configured to control an output of the hydraulic pump in proportion to the difference value between the current hydraulic pump output and the hydraulic pump output limit when the flow rate limit control function is activated according to a result of the determination of the hydraulic pump flow rate control determining unit.

Effects

As described above, according to the present specification, there are provided the method, the device, and the system for controlling the hydraulic pump of the construction machine, which control an output of the hydraulic pump in proportion to a difference value between a current hydraulic pump output and a hydraulic pump output limit, thereby preventing an increase delay of a pump torque generated according to a control of the pump torque based on a predetermined torque increase rate by an existing hydraulic pump control device, and appropriately matching a load between an engine and the hydraulic pump.

DETAILED DESCRIPTION OF CERTAIN INVENTIVE EMBODIMENTS

Figure 1:
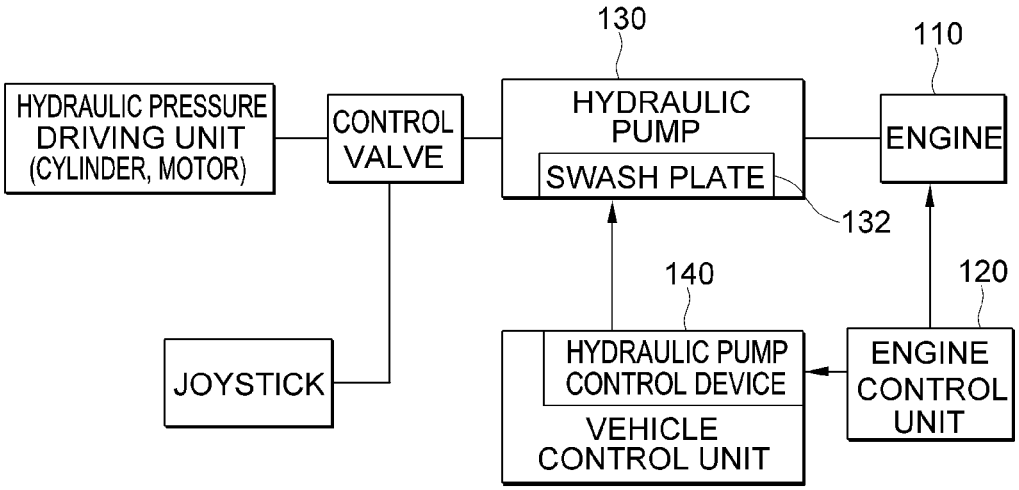
FIG. 1 is a diagram illustrating a schematic configuration of a system for controlling a hydraulic pump of a construction machine according to an exemplary embodiment of the present disclosure.

Technical terms used in the present specification are used only to describe specific exemplary embodiments, and are not intended to limit the present disclosure. Further, technical terms used in the present specification shall be construed as a meaning generally understood by those skilled in the art unless otherwise defined in the present specification, and shall not be construed in excessively general or narrow meanings. Further, when technical terms used in the present specification are improper technical terms, which fail to correctly express the present disclosure, the technical terms shall be substituted with and understood as technical terms, which those skilled in the art may properly understand. Further, a general term used in the present disclosure shall be construed according to a meaning defined in a dictionary or the context of a related description, and shall not be construed in an excessively narrow meaning.

Further, singular expressions used in the present specification include plural expressions unless they have definitely opposite meanings. In the present application, it shall not be construed that terms, such as "including" or "comprising", essentially include all of various constituent elements or steps described in the specification, and it shall be construed that some constituent elements or steps among the various constituent elements or steps may be omitted, or additional constituent elements or steps may be further included.

Further, suffixes "module" and "unit" for components used in the present specification are given or mixed and used by considering only easiness in preparing a specification and do not have a meaning or role distinguished from each other in themselves.

Terms, such as "first" and "second", including an ordinal number used in the present specification may be used for describing various constituent elements, but the constituent elements should not be limited by the terms. The terms are used only to discriminate one constituent element from another constituent element. For example, without departing from the scope of the present disclosure, a first constituent element may be referred to as a second constituent element, and similarly, the second constituent element may also be referred to as the first constituent element.

Hereinafter, an exemplary embodiment of the present disclosure will be described in detail with reference to the accompanying drawings, in which like reference numerals refer to like or similar constituent elements regardless of the reference numerals and a duplicated description thereof will be omitted.

In describing the present disclosure, when it is determined that the detailed description of the publicly known art related to the present disclosure may obscure the gist of the present disclosure, the detailed description thereof will be omitted. Further, it is noted that the accompanying drawings are used just for easily appreciating the present disclosure and it should not be analyzed that the present disclosure is limited by the accompanying drawings.

In general, a device for controlling a hydraulic pump according to an exemplary embodiment of the present disclosure is continuously operated from a moment, at which a vehicle starts, to a time when the vehicle is stalled. However, the device for controlling the hydraulic pump may be implemented so as to be operated in a special case, that is, only under a sudden load condition. In a special case, an engine control unit (ECU) and a hydraulic pump control device (electronic power optimizing system (EPOS)) need to transceiver pump torque information through CAN communication in real time. In this case, the shorter a control period is, the better the effect is, and the larger a CAN update rate is, the better the effect is. Currently, signals having a most frequent CAN update rate are updated for every 10 ms in the construction machine, so that the hydraulic pump torque information for a torque compensation engine control may be updated every 10 ms. However, to this end, a quantity of CAN information is excessively increased, so that a stable operation may not be secured by a CAN load rate. In order to respond to the situation, the hydraulic pump control operation according to the present disclosure may be performed only under the sudden load condition.

FIG. 1 is a diagram illustrating a schematic configuration of a system for controlling a hydraulic pump of a construction machine according to an exemplary embodiment of the present disclosure.

Referring to FIG. 1, the system for controlling the hydraulic pump of the construction machine according to the present disclosure includes an engine 110, an engine control unit 120 for controlling the engine 110 by using engine limit torque information and current engine torque information of the engine 110, a hydraulic pump 130 operated by power supplied from the engine 110, a hydraulic pump control device 140 for calculating a torque of the hydraulic pump 130 by using a pump discharge capacity and a pump discharge pressure of the hydraulic pump 130, and the like.

The engine control unit 120 provides the engine limit torque information and the current engine torque information. The engine control unit 120 may provide another device with the engine limit torque information and the current engine torque information in a form of a CAN signal. Accordingly, the hydraulic pump control device 140 may receive the engine limit torque information and the current engine torque information from the engine control unit 120 through CAN communication.

In the meantime, the hydraulic pump control device 140 according to the present disclosure may calculate a torque of the hydraulic pump 130 as described below.

Figure 2:
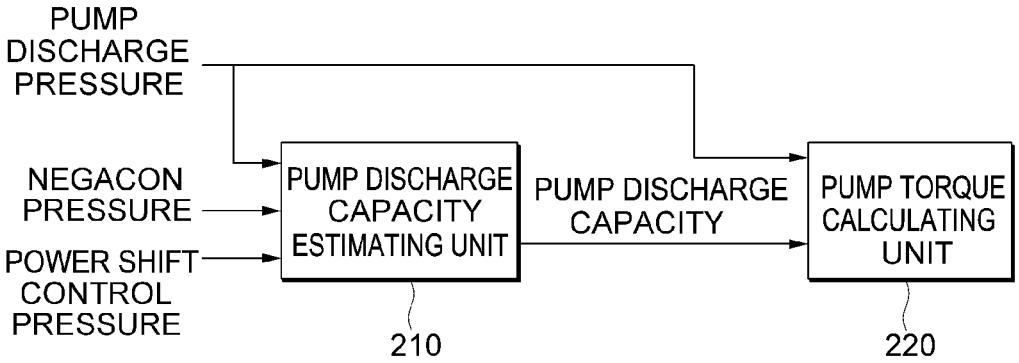
FIGS. 2 and 3 are diagrams for describing a method for calculating a torque of the hydraulic pump.

Referring to FIG. 2, the hydraulic pump control device 140 according to the present disclosure may include a pump discharge capacity estimating unit 210, a pump torque calculating unit 220, and the like.

The pump discharge capacity estimating unit 210 receives all of the pressures controlling a regulator for determining a flow rate of the hydraulic pump 130 as input values. That is, the pump discharge capacity estimating unit 210 receives a pump discharge pressure, a negacon (negative control) pressure, and a pressure for controlling power shift, which is input as the control pressure of the regulator from the hydraulic pump by the negacon control method, as the input values. The pump discharge capacity estimating unit 210 may estimate a pump discharge capacity by using a received pressure for controlling, and a predetermined table based on a design and performance experiment material of a corresponding hydraulic pump. In this case, the pump discharge capacity estimating unit 210 may estimate a pump discharge capacity by adding a time delay element considering a dynamic delay property of a swash plate angle.

Next, the pump torque calculating unit 220 calculates a torque of the hydraulic pump 130 by using the measured pump discharge pressure and the pump discharge capacity estimated by the pump discharge capacity estimating unit 210.

In this case, a method for calculating a torque of the hydraulic pump 130 by using the pump discharge pressure and the pump discharge capacity by the pump torque calculating unit 220 may be divided into two methods.

First, the pump torque calculating unit 220 may calculate a torque of the hydraulic pump 130 by using a pump discharge pressure Pd, a pump discharge capacity q, and pump efficiency η, as expressed by Equation 1 below.

$$TQ=[(PdSq)/2\pi]/\eta \quad \text{[Equation 1]}$$

Here, TQ represents a pump torque, Pd represents a pump discharge pressure, q represents a pump discharge capacity, and η represents pump efficiency.

Second, the pump torque calculating unit 220 may calculate a torque of the hydraulic pump 130 by using a pre-stored table. Here, the table may be a table including pump discharge pressures and pump discharge capacities based on the design and a test result of the hydraulic pump, as input values.

The pump torque calculating unit 220 may calculate a torque of the hydraulic pump 130 by applying interpolation to an adjacent value of the table for an input value, which is not present in the table.

When the hydraulic pump is a hydraulic pump of another control method, not the hydraulic pump of the negacon control method, the pump discharge capacity estimating unit 210 may estimate the pump discharge capacity by using a control pressure of the regulator controlling a swash plate 132 of the hydraulic pump 130. Here, the regulator may control a swash plate of a capacity variable type hydraulic pump.

Figure 3:
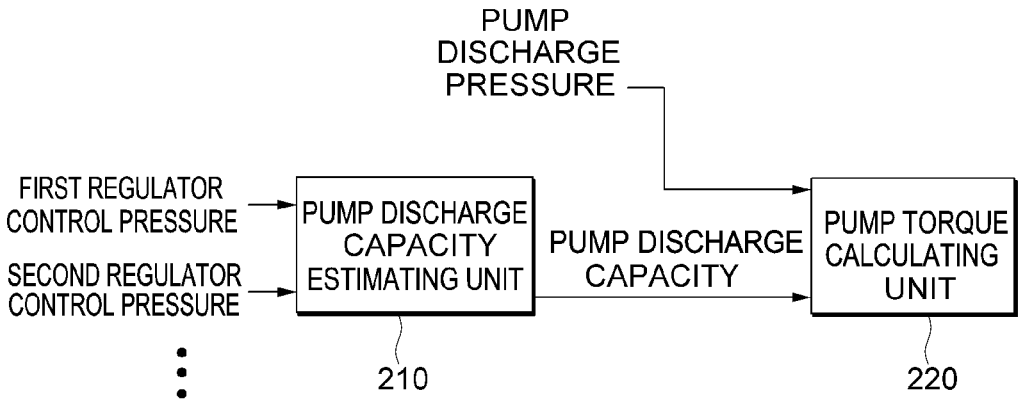

As illustrated in FIG. 3, when the regulator controlling the swash plate 132 of the hydraulic pump 130 is controlled by a first regulator control pressure and a second regulator control pressure, the pump discharge capacity estimating unit 210 may estimate a pump discharge capacity by using the first regulator control pressure and the second regulator control pressure. In this case, when the regulator is controlled by the first regulator control pressure, the second regulator control pressure, . . . , and an $N^{th}$ regulator control pressure, the pump discharge capacity estimating unit 210 may estimate a pump discharge capacity by using the first regulator control pressure, the second regulator control pressure, . . . , and the $N^{th}$ regulator control pressure. That is, the first regulator control pressure, the second regulator control pressure, and the like, which are transmitted as control inputs for the regulator may be input to the pump discharge capacity estimating unit 210. The pump discharge capacity estimated by the pump discharge capacity estimating unit 210 may be transmitted to the pump torque calculating unit 220 similar to FIG. 2, so that a torque of the hydraulic pump 130 may be calculated.

Further, the pump discharge capacity estimating unit 210 may also estimate a pump discharge capacity by using a value measured by a swash plate angle sensor installed in the swash plate 132 of the hydraulic pump 130.

The hydraulic pump control device 140 may control a swash plate angle or a limited swash plate angle of the hydraulic pump 130 by using the torque of the hydraulic pump 130 and the engine limit torque information received from the engine control unit 120.

Further, the limited swash plate angle of the hydraulic pump according to the engine limit torque information may be predetermined by an engine manufacturing company, a pump manufacturing company, or a construction machine manufacturing company. Here, the limited swash plate angle of the hydraulic pump corresponding to the engine limit torque information may be pre-created in the form of a table. Accordingly, the table may be embedded in the hydraulic pump control device 140 in the form of table values based on the designs and test results of the engine and the hydraulic pump. Accordingly, the hydraulic pump control device 140 may control the swash plate 132 of the hydraulic pump 130 according to the limited swash plate angle of the hydraulic pump stored in the table. Here, the limited swash plate angle means a maximum control value of the swash plate angle controlled according to the engine limit torque information. The limited swash plate angle matched one to one to an engine torque limit value may be configured in a form of a table or an engine torque limit value and the limited swash plate angle may be functionalized.

Further, the hydraulic pump control device 140 may control an output of the hydraulic pump 130 by limiting a torque of the hydraulic pump 130 in proportion to a difference value between a current hydraulic pump output and a hydraulic pump output limit. For example, the hydraulic pump control device 140 may control an output of the hydraulic pump 130 by limiting an increase inclination of a torque of the hydraulic pump 130 in proportion to a difference value between a current hydraulic pump output and a hydraulic pump output limit. Accordingly, the hydraulic pump control device 140 may control both of a flow control type pump and a pressure control type pump in proportion to the same reference, that is, a difference value between a current hydraulic pump output and a hydraulic pump output limit.

Further, when a difference value between the engine limit torque information and the torque of the hydraulic pump 130 is equal to or greater than a specific value, the hydraulic pump control device 140 may additionally correct the limited swash plate angle of the hydraulic pump 130 to be decreased. When the difference value between the engine limit torque information and the torque of the hydraulic pump 130 is equal to or greater than the specific value, the hydraulic pump control device 140 may maximize a usable output of the engine 110 by increasing a torque of the hydraulic pump 130 by increasing the limited swash plate angle of the hydraulic pump 130 to be greater than a predetermined value.

Further, the hydraulic pump control device 140 may maintain the current engine torque information so as not to exceed the engine limit torque information by regularly controlling a torque of the hydraulic pump 130 based on the engine limit torque information.

Further, the hydraulic pump control device 140 may also limit the increase inclination of the torque of the hydraulic pump 130 based on the engine limit torque information. That is, the hydraulic pump control device 140 may also maintain the current engine torque information so as not to exceed the engine limit torque information by using a limit value of the increase inclination of the torque (a torque rate limit) of the hydraulic pump 130 as a control variable, based on the engine limit torque information.

Figure 4:
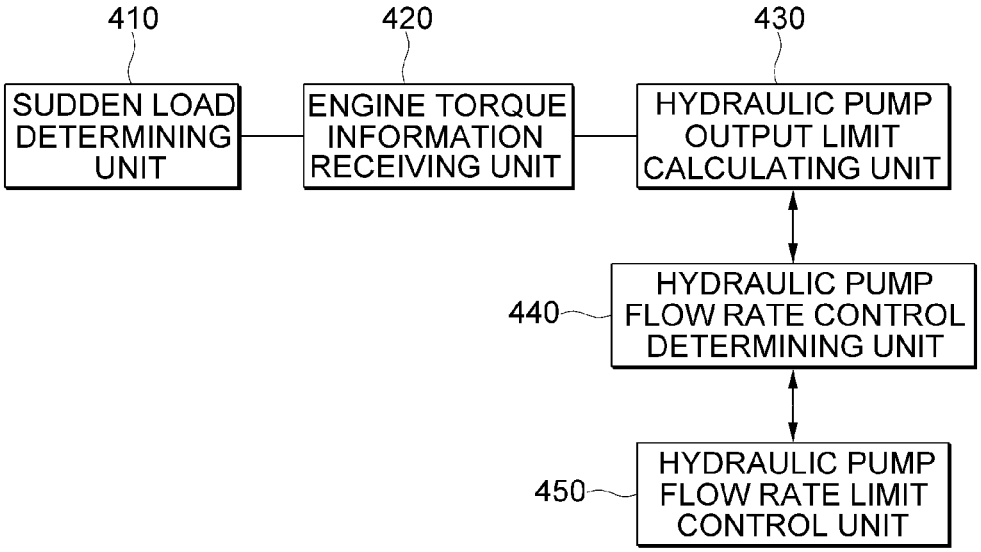
FIG. 4 is a block diagram illustrating a schematic configuration of a device for controlling a hydraulic pump of a construction machine according to an exemplary embodiment of the present disclosure.

FIG. 4 is a block diagram illustrating a schematic configuration of a device for controlling a hydraulic pump of a construction machine according to an exemplary embodiment of the present disclosure.

Referring to FIG. 4, the hydraulic pump control device 140 according to the present disclosure includes a sudden load determining unit 410, an engine torque information receiving unit 420, a hydraulic pump output limit calculating unit 430, a hydraulic pump flow rate control determining unit 440, a hydraulic pump flow rate limit control unit 450, and the like.

The sudden load determining unit 410 determines whether a sudden load is generated by using an increase rate of the pump discharge pressure. Particularly, the sudden load determining unit 410 determines whether an increase rate of the pump discharge pressure is equal to or greater than a predetermined increase rate $\Delta P/\Delta T$, and determines whether a duration time of the increase rate of the pump discharge pressure is equal to or greater than a predetermined duration time $\Delta T1$, thereby determining whether a sudden load of the hydraulic pump 130 is generated. That is, when the increase rate of the pump discharge pressure is equal to or greater than the predetermined increase rate $\Delta P/\Delta T$, and the duration time of the increase rate of the pump discharge pressure is equal to or greater than the predetermined duration time $\Delta T1$, the sudden load determining unit 410 determines that the sudden load is generated in the hydraulic pump 130. A low pass filter may be applied to an input terminal of the sudden load determining unit 410 to prevent an erroneous operation.

When a sudden load is generated in the hydraulic pump 130 according to a result of the determination of the sudden load determining unit 410, the engine torque information receiving unit 420 receives the engine limit torque information and the current engine torque information by using the CAN protocol from the engine control unit 120. Here, the engine limit torque information includes a fuel quantity limited under exhaust gas regulations or engine torque information determined by the limited fuel quantity, and limit values of a torque and a fuel quantity limited for durability or performance protection of the engine, and the current engine torque information includes a currently estimated torque generation value of the engine.

The hydraulic pump output limit calculating unit 430 calculates a hydraulic pump output limit supplied to the hydraulic pump 130 by using the engine limit torque information received through the engine torque information receiving unit 420. Particularly, the hydraulic pump output limit calculating unit 430 calculates a pump flow rate limit corresponding to the engine torque by using the engine limit torque information and a pump model of the flow rate limit control unit 450, and calculates a hydraulic pump output limit to be limited based on the calculated pump flow rate limit and the current pump discharge pressure. Here, the pump flow rate limit is a flow rate which needs to be limited by the hydraulic pump flow rate limit control unit 450.

The hydraulic pump flow rate control determining unit 440 compares the hydraulic pump output limit calculated by the hydraulic pump output limit calculating unit 430 with the current hydraulic pump output calculated by using the flow rate calculated by using the pump discharge pressure and the pump model, and when the current hydraulic pump output is greater than the hydraulic pump output limit, and a difference value between the current engine torque information and the engine limit torque information is equal to or smaller than a predetermined reference value $\Delta TQ$, the hydraulic pump flow rate control determining unit 440 determines that a flow rate control function is activated.

Further, when the current hydraulic pump output is smaller than the hydraulic pump output limit, the hydraulic pump flow rate control determining unit 440 determines that the flow rate control function is not activated.

When the flow rate control function is activated according to a result of the determination of the hydraulic pump flow rate control determining unit 440, the hydraulic pump flow rate limit control unit 450 controls an output of the hydraulic pump 130 in proportion to a difference value between the current hydraulic pump output and the hydraulic pump output limit by using a power shift control pressure (Pf pressure).

In this case, the hydraulic pump flow rate control unit 450 may control an output of the hydraulic pump 130 by limiting a torque of the hydraulic pump 130 in proportion to the difference value between the current hydraulic pump output and the hydraulic pump output limit.

Further, the hydraulic pump flow rate limit control unit 450 may control an output of the hydraulic pump 130 by limiting an increase inclination of the torque of the hydraulic pump 130 in proportion to the difference value between the current hydraulic pump output and the hydraulic pump output limit. Accordingly, it is possible to control both of the flow rate control type pump and the pressure control type pump in proportion to the same reference, that is, the difference value between the current hydraulic pump output and the hydraulic pump output limit.

In addition, the hydraulic pump flow rate limit control unit 450 may be applied to various environments and various types of device by assigning a predetermined weighted value to the difference value between the current hydraulic pump output and the hydraulic pump output limit.

As described above, when the output is limited by the power shift control of the hydraulic pump flow rate limit control unit 450, the swash plate is operated in a direction of decreasing a flow rate, and it is possible to reduce excessive injection of the fuel by decreasing a burden of the engine, and a load of the hydraulic pump may be decreased, thereby improving a rotation response of the engine.

Further, when the flow rate control function is inactivated according to the result of the determination of the hydraulic pump flow rate control determining unit 440, the hydraulic pump flow rate limit control unit 450 controls an output of the hydraulic pump 130 according to a predetermined value.

In addition, when a difference value between the target engine speed and an the actual engine speed is equal to or smaller than a predetermined reference value ΔN, the hydraulic pump flow rate limit control unit 450 terminates the control of an output of the hydraulic pump 130.

Figure 5:
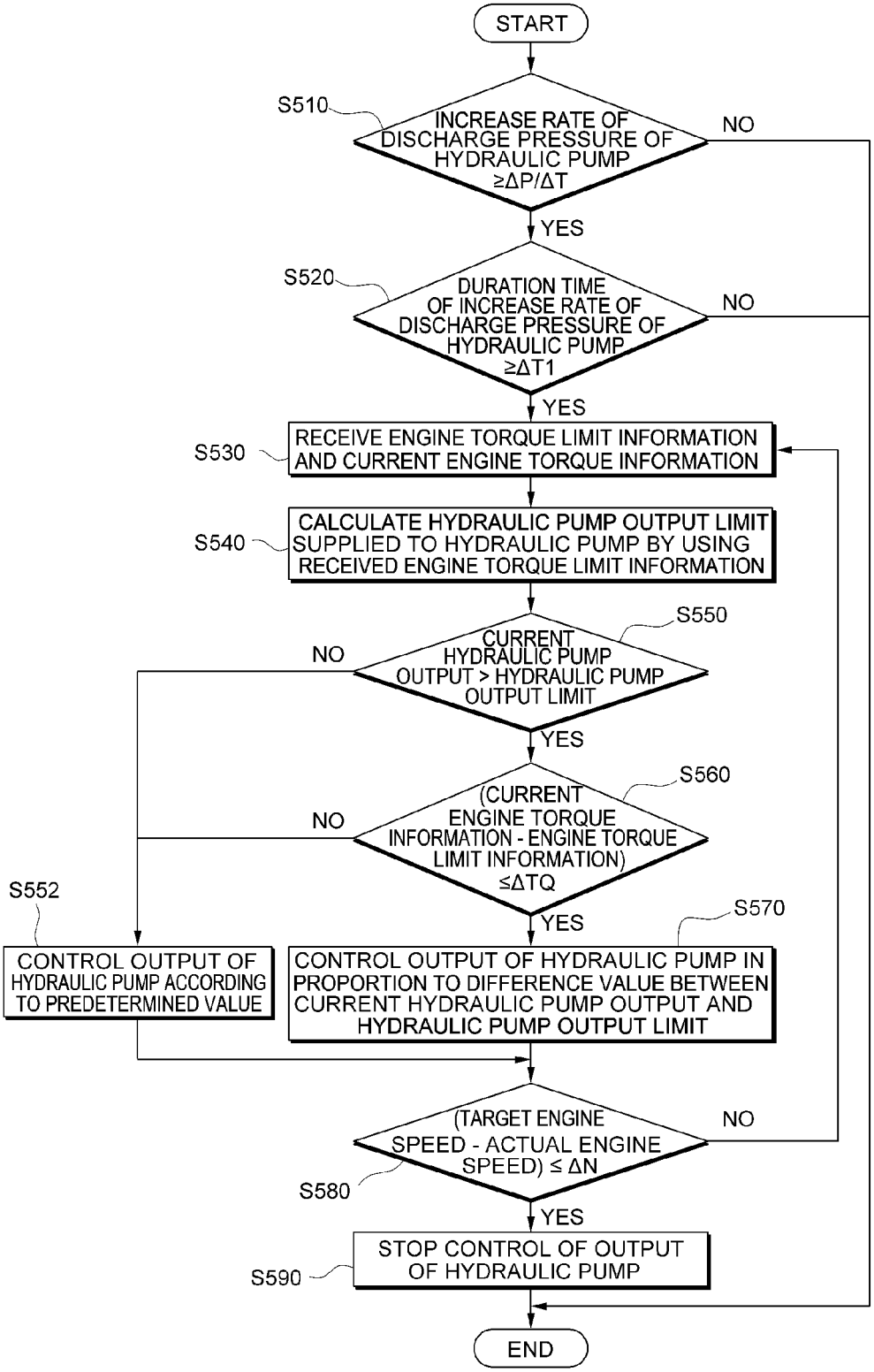
FIG. 5 is a flowchart illustrating a method for controlling a hydraulic pump of a construction machine according to an exemplary embodiment of the present disclosure.

FIG. 5 is a flowchart illustrating a method for controlling a hydraulic pump of a construction machine according to an exemplary embodiment of the present disclosure.

Referring to FIG. 5, it is determined whether an increase rate of the pump discharge pressure is equal to or greater than a predetermined increase rate (ΔP/ΔT) (S510).

When the increase rate of the pump discharge pressure is equal to or greater than the predetermined increase rate, it is determined whether a duration time of the increase rate of the pump discharge pressure is equal to or greater than a predetermined duration time (ΔT1) (S520).

When the duration time of the increase rate of the pump discharge pressure is equal to or greater than the predetermined duration time, it is determined that the sudden load is generated in the hydraulic pump 130, and engine limit torque information and current engine torque information are received from the engine control unit 120 (S530).

A hydraulic pump output limit supplied to the hydraulic pump 130 is calculated by using the received engine limit torque information (S540). Particularly, a pump flow rate limit corresponding to the engine torque is calculated by using the engine limit torque information and a pump model of the hydraulic pump flow rate limit control unit 450, and a hydraulic pump output limit to be limited is calculated based on the calculated pump flow rate limit and the current pump discharge pressure.

Next, it is determined whether a current hydraulic pump output, which is calculated by using the flow rate calculated by using the pump discharge pressure and the pump model, is greater than the hydraulic pump output limit (S550).

When the current hydraulic pump output is greater than the hydraulic pump output limit, it is determined whether a difference value between the current engine torque information and the engine limit torque information is equal to or smaller than a predetermined reference value (ΔTQ) (S560).

When the difference value between the current engine torque information and the engine limit torque information is equal to or smaller than the predetermined reference value, it is determined that a flow rate control function is activated, so that an output of the hydraulic pump 130 is controlled in proportion to a difference value between a current hydraulic pump output and a hydraulic pump output limit (S570).

When the current hydraulic pump output is smaller than the hydraulic pump output limit, or the difference value between the current engine torque information and the engine limit torque information exceeds the predetermined reference value, it is determined that the flow rate control function is inactivated, so that an output of the hydraulic pump 130 is controlled according to a predetermined value (S552).

In addition, it is determined whether a difference value between a target engine speed and an actual engine speed is equal to or smaller than a predetermined reference value ΔN (S580).

When the difference value between the target engine speed and the actual engine speed is equal to or smaller than the predetermined reference value, the control of the output of the hydraulic pump 130 is stopped regardless of activation or inactivation of the flow rate control function (S590).

When the difference value between the target engine speed and the actual engine speed exceeds the predetermined reference value, the operation returns to operation S530, and the engine limit torque information and the current engine torque information are received, and then subsequent procedures are sequentially performed.

Figure 6:
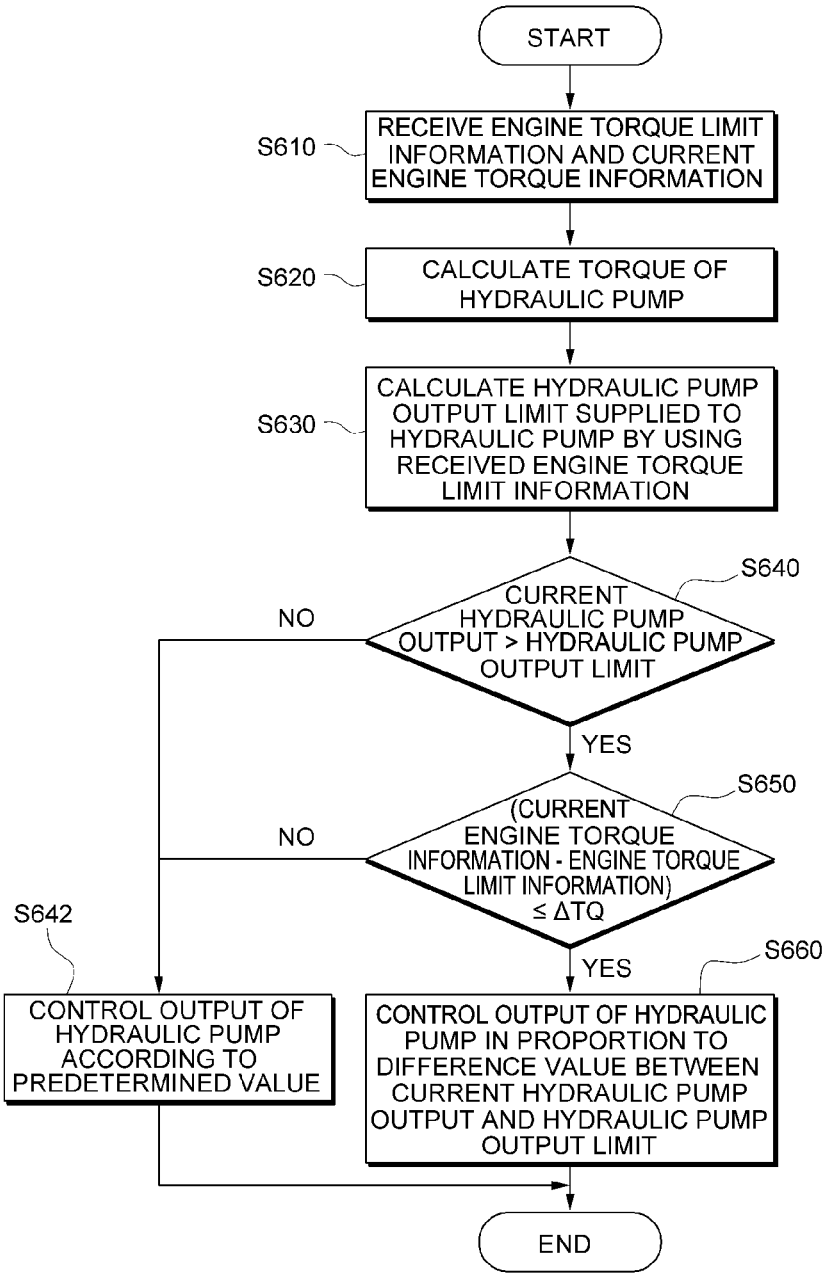
FIG. 6 is a flowchart of a method for controlling a hydraulic pump of a construction machine according to another exemplary embodiment of the present disclosure.

FIG. 6 is a flowchart of a method for controlling a hydraulic pump of a construction machine according to another exemplary embodiment of the present disclosure.

Referring to FIG. 6, engine limit torque information and current engine torque information are received from the engine control unit 120 (S610).

A torque of the hydraulic pump is calculated (S620). In this case, as described above, the torque of the hydraulic pump 130 may be calculated by using a pump discharge pressure Pd, a pump discharge capacity q, and pump efficiency η or by using a pre-stored table, that is, a table including a pump discharge pressure and a pump discharge capacity based on a design and a test result of the hydraulic pump, as input values.

Next, a hydraulic pump output limit supplied to the hydraulic pump 130 is calculated by using the received engine limit torque information (S630). Particularly, a pump flow rate limit corresponding to an engine torque is calculated by using the engine limit torque information and a pump model of the hydraulic pump flow rate limit control unit 450, and a hydraulic pump output limit to be limited is calculated based on the calculated pump flow rate limit and the current pump discharge pressure.

Next, it is determined whether the current hydraulic pump output, which is calculated by using the flow rate calculated by using the pump discharge pressure and the pump model is greater than the hydraulic pump output limit (S640).

When the current hydraulic pump output is greater than the hydraulic pump output limit, it is determined whether a difference value between the current engine torque information and the engine limit torque information is equal to or smaller than a predetermined reference value (ΔTQ) (S650).

When the difference value between the current engine torque information and the engine limit torque information is equal to or smaller than the predetermined reference value, it is determined that a flow rate control function is activated, so that an output of the hydraulic pump 130 is controlled in proportion to a difference value between an current hydraulic pump output and a hydraulic pump output limit (S660).

When the current hydraulic pump output is smaller than the hydraulic pump output limit, or the difference value between the current engine torque information and the engine limit torque information exceeds the predetermined reference value, it is determined that the flow rate control function is inactivated, so that an output of the hydraulic pump 130 is controlled according to a predetermined value (S642).

The aforementioned method may be implemented by various means. For example, the exemplary embodiments of the present disclosure may be implemented by hardware, firmware, software, or a combination thereof.

When the exemplary embodiments of the present disclosure are implemented by hardware, the method according to the exemplary embodiments of the present disclosure may be implemented by one or more of application specific integrated circuits (ASICs), digital signal processors (DSPs), digital signal processing devices (DSPDs), programmable logic devices (PLDs), field programmable gate arrays (FPGAs), processors, controllers, microcontrollers, and microprocessors.

When the exemplary embodiments of the present disclosure are implemented by firmware or software, the method according to the exemplary embodiments of the present disclosure may be implemented in a form of a module, a procedure, a function, and the like performing the aforementioned functions or operations. A software code may be stored in a memory unit and driven by a processor. The memory unit may be positioned inside or outside the processor to transceive data with the processor by already publicly known various means.

The exemplary embodiments disclosed in the present specification have been described with reference to the accompanying drawings. As described above, the exemplary embodiments illustrated in the respective drawings shall not be limitedly construed, and it may be construed that the exemplary embodiments may be combined by those who fully understand the contents of the present specification, and when the exemplary embodiments are combined, some constituent elements may be omitted.

Here, the terms or words used in the present specification and the claims should not be construed as being limited as a commonly used or lexical meaning, and should be construed as a meaning and a concept to conform to the technical idea disclosed in the present specification.

Therefore, the exemplary embodiments described in the present specification and the configurations illustrated in the drawings are only an exemplary embodiment disclosed in the present specification and do not represent all of the technical idea disclosed in the present specification, and thus it is to be understood that various equivalent matters and modified examples, which may replace the exemplary embodiments and the configurations, are possible at the time of filing the present application.

INDUSTRIAL APPLICABILITY

According to the method, the device, and the system for controlling the hydraulic pump of the construction machine according to the present disclosure, it is possible to provide a method, a device, and a system for controlling a hydraulic pump of a construction machine, which control an output of a hydraulic pump in proportion to a difference value between a current hydraulic pump output and a hydraulic pump output limit, so that it is possible to prevent an increase delay of a pump torque generated according to a control of the pump torque based on a predetermined torque increase rate by an existing hydraulic pump control device, and appropriately match a load between an engine and the hydraulic pump, which exceeds a limit of the related art, so that the present disclosure can be used for the relevant technology, and further, a device, to which the present disclosure is applied, may sufficiently be marketed or available to sell, and the method, the device, and the system for controlling the hydraulic pump of the construction machine according to the present disclosure may be actually and clearly carried out, thereby being an industrially applicable invention.

The invention claimed is:

1. A system for controlling a hydraulic pump of a construction machine, the system comprising:

an engine;

an engine control unit configured to control the engine;

a hydraulic pump operated by power supplied from the engine;

at least one actuator driven by a hydraulic pressure discharged from the hydraulic pump; and a hydraulic pump control device configured to control a swash plate angle of the hydraulic pump by using a torque of the hydraulic pump and engine limit torque information received from the engine control unit, wherein the engine control unit controls the engine by using the engine limit torque information and current engine torque information of the engine, wherein the hydraulic pump control device controls a maximum control value of the swash plate angle of the hydraulic pump by using the torque of the hydraulic pump and the engine limit torque information received from the engine control unit, wherein the hydraulic pump control device additionally corrects the maximum control value of the swash plate angle of the hydraulic pump according to a difference value between the engine limit torque information and the torque of the hydraulic pump.

2. The system of claim 1, wherein the hydraulic pump control device calculates the torque of the hydraulic pump by using a pump discharge capacity and a pump discharge pressure.

3. The system of claim 2, wherein the hydraulic pump control device calculates the pump discharge capacity by using the pump discharge pressure, a negacon pressure, and a power shift control pressure.

4. The system of claim 2, wherein the hydraulic pump control device calculates the pump discharge capacity by using a plurality of regulator control pressures or a value measured by a swash plate angle sensor.

5. The system of claim 1, wherein the hydraulic pump control device limits a rate of increase of the torque of the hydraulic pump based on the engine limit torque information.

6. A method for controlling a hydraulic pump of a construction machine, the method comprising:

receiving engine limit torque information and current engine torque information;

calculating a torque of the hydraulic pump; and calculating a hydraulic pump fluid output limit, by using the received engine limit torque information and the torque of the hydraulic pump, determining whether a current hydraulic pump fluid output calculated by using a pump discharge pressure and a pump model is larger than the hydraulic pump fluid output limit, determining whether a difference value between the current engine torque information and the engine limit torque information is equal to or smaller than a predetermined reference value when the current hydraulic pump fluid output is greater than the hydraulic pump fluid output limit; and controlling an output of the hydraulic pump in proportion to a difference value between the current hydraulic pump fluid output and the hydraulic pump fluid output limit when the difference value between the current engine torque information and the engine limit torque information is equal to or smaller than the predetermined reference value.

7. The method of claim 6, wherein the calculating of the hydraulic pump fluid output limit includes:

calculating a pump flow rate limit corresponding to an engine torque by using the engine limit torque information and the pump model; and calculating the hydraulic pump fluid output limit by using the calculated pump flow rate limit and a current pump discharge pressure.

8. The method of claim 6, further comprising:

controlling an output of the hydraulic pump according to a predetermined value when the current hydraulic pump fluid output is smaller than the hydraulic pump fluid output limit.

9. The method of claim 6, further comprising:

when the difference value between the current engine torque information and the engine limit torque information exceeds the predetermined reference value, controlling the output of the hydraulic pump according to a predetermined value.

10. The method of claim 6, wherein the controlling of the output of the hydraulic pump includes limiting the torque of the hydraulic pump in proportion to the difference value between the current hydraulic pump fluid output and the hydraulic pump fluid output limit.

11. The method of claim 6, wherein the controlling of the output of the hydraulic pump includes limiting an increase rate of the torque of the hydraulic pump in proportion to the difference value between the current hydraulic pump fluid output and the hydraulic pump fluid output limit.

12. A method for controlling a hydraulic pump of a construction machine, the method comprising:

receiving engine limit torque information and current engine torque information;

calculating a torque of the hydraulic pump; and calculating a hydraulic pump fluid output limit, by using the received engine limit torque information and the torque of the hydraulic pump, determining whether a current hydraulic pump fluid output calculated by using a pump discharge pressure and a pump model is larger than the hydraulic pump fluid output limit, determining whether an increase rate of the pump discharge pressure is equal to or greater than a predetermined increase rate;

determining whether a duration time of the increase rate of the pump discharge pressure is equal to or greater than a predetermined duration time when the increase rate of the pump discharge pressure is equal to or greater than the predetermined increase rate; and wherein the engine limit torque information and the current engine torque information are received only when the duration time of the increase rate of the pump discharge pressure is equal to or greater than the predetermined duration time.

13. A device for controlling a hydraulic pump of a construction machine, the device comprising:

an engine torque information receiving unit configured to receive engine limit torque information and current engine torque information;

a hydraulic pump output limit calculating unit configured to calculate a hydraulic pump fluid output limit, by using the engine limit torque information received through the engine torque information receiving unit;

a hydraulic pump flow rate control determining unit configured to determine whether a current hydraulic pump fluid output calculated by using a pump discharge pressure and a pump model is greater than a hydraulic pump fluid output limit calculated by the hydraulic pump fluid output limit calculating unit, determine whether a difference value between the current engine torque information and the engine limit torque information is equal to or smaller than a predetermined reference value, and determine whether a flow rate limit control function is activated; and a hydraulic pump flow rate limit control unit configured to control an output of the hydraulic pump in proportion to a difference value between the current hydraulic pump fluid output and the hydraulic pump fluid output limit when the flow rate limit control function is activated according to a result of the determination of the hydraulic pump flow rate control determining unit.

14. The device of claim 13, wherein the hydraulic pump fluid output limit calculating unit calculates a pump flow rate limit corresponding to an engine torque by using the engine limit torque information and the pump model, and calculates the hydraulic pump fluid output limit by using the calculated pump flow rate limit and a current pump discharge pressure.

15. The device of claim 13, wherein the hydraulic pump flow rate limit control unit assigns a predetermined weighted value to the difference value between the current hydraulic pump fluid output and the hydraulic pump fluid output limit.

16. The device of claim 13, further comprising:

a sudden load determining unit configured to determine whether a sudden load is generated by using an increase rate of the pump discharge pressure, wherein when the sudden load is generated in the hydraulic pump according to a result of the determination of the sudden load determining unit, the engine torque information receiving unit receives the engine limit torque information and the current engine torque information.

* * * * *